US005246739A

United States Patent [19]

Lin

[11] Patent Number: 5,246,739

[45] Date of Patent: Sep. 21, 1993

[54] METHOD FOR THE TREATMENT OF WOOD WITH METAL-LIGNIN SALTS

[75] Inventor: Stephen Y. Lin, Wausau, Wis.

[73] Assignee: LignoTech USA, Inc., Rothschild, Wis.

[21] Appl. No.: 825,032

[22] Filed: Jan. 24, 1992

[51] Int. Cl.[5] ..... B05D 7/06

[52] U.S. Cl. ..... 427/393; 427/351

[58] Field of Search ..... 427/440, 393, 297, 382, 427/351

[56] References Cited

U.S. PATENT DOCUMENTS

| | | | |
|---|---|---|---|
| 3,877,976 | 4/1975 | Olson et al. | 427/317 |
| 3,915,911 | 10/1975 | Horiguchi | 106/18.13 |
| 4,008,342 | 2/1977 | Richardson | 427/297 |
| 4,107,111 | 8/1978 | Lindberg et al. | 106/163.1 |
| 4,183,997 | 1/1980 | Stofko | 427/415 |
| 4,186,242 | 1/1980 | Holmquist | 427/415 |
| 4,225,637 | 9/1980 | Richardson | 427/351 |
| 4,301,217 | 11/1981 | Rohringer et al. | 427/297 |
| 4,325,993 | 4/1982 | Schroder | 427/351 |
| 4,364,976 | 12/1982 | Prokofievna et al. | 427/297 |
| 4,382,105 | 5/1983 | Amundsen et al. | 427/297 |
| 4,649,065 | 3/1987 | Hein et al. | 427/440 |
| 4,752,509 | 6/1988 | Simonson et al. | 106/18.34 |
| 4,871,473 | 10/1989 | Goettsche et al. | 427/351 |
| 4,988,576 | 1/1991 | Lin et al. | 428/537.1 |
| 5,078,912 | 1/1992 | Goettsche et al. | 427/351 |

*Primary Examiner*—Terry J. Owens
*Assistant Examiner*—Diana Dudash
*Attorney, Agent, or Firm*—Andrus, Sceales, Starke & Sawall

[57] ABSTRACT

A method for treatment of wood, whereby the wood is impregnated with a wood preservative composition consisting essentially of an aqueous solution of ammonium salt of lignin and ammonia complexes of certain metal cations such as $Cu(NH_3)_4{}^{++}$, $Zn(NH_3)_4{}^{++}$, and $Hg(NH_3)_2{}^{++}$. the lignin is selected from the group consisting of alkali lignin, organosolv lignin, partially desulfonated sulfite lignin, and modified alkali or organosolv lignin.

12 Claims, No Drawings

METHOD FOR THE TREATMENT OF WOOD WITH METAL-LIGNIN SALTS

BACKGROUND OF THE INVENTION

This invention relates to a method for the treatment of wood to prevent decay, and more particularly, it is pertinent to a one-step treatment of wood with an aqueous solution of lignin materials and certain ammonia complexes of metals.

In the United States, as in many other countries possessed of abundant timber resources, wood has always been an important construction material. Its good availability, low heat conductivity, and sound-deadening qualities, have made it the outstanding building material since early human history. However, two major destructive forces of wood are fire and decay. While fire is often caused by human factors, decay is due :o biological attacks by microorganisms (such as fungi and bacteria), marine borers and insects. Much of the decay of wood in service is inevitable. It is particularly severe as a result of the activities of low forms of plants known as wood-destroying fungi. This type of fungi often causes extensive damage and financial loss to buildings in the temperate zone.

The conditions necessary for the development of decay-producing fungi in wood are: (1) a supply of suitable wood, (2) a sufficient amount of moisture, (3) at least a small amount of air, and (4) a favorable temperature. A deficiency in any of these requirements will inhibit the growth of a fungus, and reduce the decay of wood. Under normal service conditions of wood, the deficiency is difficult to maintain. So, a more common method for preserving wood against the fungal attacks is to impregnate it with certain wood preservatives. There are generally two types of wood preservatives. Oil-borne preservatives include creosote, pentachlorophenol, copper naphthenate, zinc naphthenate, copper-8-quinolinolate and others. Important water-borne preservatives are arsenic salts, boric acid, chromium salts, chromated zinc chloride, copper sulfate, mercuric chloride, sodium pentachlorophenate, zinc sulfate, chromated copper arsenate, etc.

According to a marketing study (*Forest Industries*, November 1985, pp. 36–38), chromated copper arsenate (or CCA) is the current most widely used lumber preservative in the U.S. About 95% of treated lumber (a total of 4 billion board feet in 1984) is treated with CCA, a water-borne preservative composed of metallic salts. CCA gives the lumber the best available protection against decay and insects. Southern yellow pine from southern lumber mills represents almost three-quarters of treated lumber. The rest is treated yellow pine lumber in the Northeast and treated pine in the Midwest. Wood preservatives such as those described above have been applied to the wood as solutions, emulsions, pastes or dispersions in liquid hydrocarbons and/or aqueous systems. In many applications, aqueous systems are preferred over liquid hydrocarbons because of the odors, flammability and often toxic nature of the hydrocarbon products. In contrast, water-borne preservatives tend to be less odorous, non-flammable, and give a clear appearance to the treated wood. Yet, aqueous preservative compositions often contain chromium and arsenate that are considered to constitute a significant risk to human health and the environment. For these and other reasons, a need exists for low-cost, non-hazardous, water-borne preservatives that contain no toxic chemical ingredients.

A common approach to achieving the object in the prior art involve fixation of certain metals such as zinc, copper, mercury, antimony, lead and so on in the wood with carboxylic organic compounds. For example, U.S. Pat. No. 4,783,221 (Nov. 8, 1988) teaches the use of a preservative compound comprising a metal salt of organic carboxylic acids of six to about 30 carbon atoms and an isothiazolone compound in preserving wood. Swedish Patent No. SE 430865 B (Dec. 19,1983) reveals a preservative composition containing copper or zinc salt of acetic and propionic acids. Australian Patent AU 519416 B2 (Nov. 12, 1981) discloses a mixture of copper oxide, decanoic acid and ethanolamine. Canadian Patent No. CA 978474 (Nov. 25, 1975) claims the use of zinc or copper salt of fatty acid as wood preservatives.

Lignin is a natural organic polymer that has recently been demonstrated in the prior art to be a suitable material for fixation of metals in wood. Thus, in U.S. Pat. No. 4,752,509 (Jun. 21, 1988), a method was disclosed for preventing the attack of wood by fungi and bacteria by the use of a modified alkali lignin. The method comprises the application of an aqueous solution of the alkali lignin modified into a water-soluble form, characterized in that the impregnation of wood takes place in two stages, these being an initial stage in which the aqueous solution containing the lignin, still in its water-soluble form and with a pH not exceeding 10, is applied to the timber (wood) in order to be absorbed by it, and a second stage in which the lignin is fixed being transformed into an essentially water-insoluble form in order to be retained in the timber, said second stage involving the application of a weakly acidic aqueous solution containing a metal salt or a combination of metal salts, said metal being zinc, copper or aluminum. The most common alkali lignin is the kraft lignin (or sulfate lignin) produced in the pulping of wood by the kraft process. The other alkali lignin is the lignin produced in the soda pulping process (soda lignin, currently not available commercially). Alkali lignin is generally water-insoluble and may be rendered water-soluble by certain carboxylation and sulfonation reactions as are practiced in U.S. Pat. No. 4,752,509. The nature of alkali lignin is such that in a mildly carboxylated and/or sulfonated form, it is water-soluble at neutral or slightly alkaline pH, but becomes insolubilized at acidic pH. The so-called water-soluble modified alkali lignin also tends to be "salted-out" by metal salts. This is the basic principle of fixation of lignin (with weakly acidic solution of metal salts) taught by the prior art. The two-stage method for impregnation of wood revealed in U.S. Pat. No. 4,752,509 suffers from several disadvantages which include, but not limited to, (1) costly drying of timber is required between the two stages, (2) the two-stage process is time-consuming since it involves loading of the same timber twice into the treatment vessel, and (3) the method is difficult and impractical to operate by the wood preserving industry due to equipment constraints.

Besides alkali lignin, the other major type of lignin produced by the paper industry is sulfite lignin (or lignosulfonate) from pulping of wood by the sulfite process. Lignosulfonate is water-soluble at all pH's, including acidic, neutral and alkaline pH's. In general, it cannot be insolubilized by addition of mineral acids or metal salts. Therefore, lignosulfonate as derived normally from the sulfite pulping liquors cannot be "fixed" into the wood by aforementioned two-step method.

Lignosulfonate absorbed into the wood that is subsequently treated with acidic aqueous solution of metal salts such as copper and zinc salts, is easily leached out of the wood by water and it loses its effectiveness as a wood preservative.

Between the two commercial lignins available in the marketplace, lignosulfonate is produced in a quantity (1,340 million kilograms per annum) at least 30 times greater than that of kraft lignin. The unproportionally greater quantity makes it attractive and desirable to produce a wood preservative composition based on sulfite lignin. Thus, in U.S. Pat. No. 4,988,576 (Jan. 29, 1991) is revealed a wood preservative composition that consists of a lignosulfonate copolymer and a metal salt (plus optionally methylol phenol), and that can be applied to the wood by the standard one-step pressure/-vacuum process commonly practiced in the industry. The distinction between the two prior art disclosures on lignin-based wood preservatives is clear in that while the kraft modified lignin is "fixed" (or rendered insoluble) in the wood by acid and metal salts (a salting-out effect), the lignosulfonate copolymer is retained in the wood by in situ condensation by itself or with methylol phenol during the drying process. Both of the lignin prior art disclosures have clearly demonstrated the efficacy of lignin as a fixation agent for metal salts in the wood and as a component in wood preservative compositions. Nevertheless, neither of the disclosures is free from deficiencies. The two-stage method of U.S. Pat. No. 4,752,509 is not readily adaptable to the industry, and the preservative of U.S. Pat. No. 4,988,576 has to resort to the use of certain expensive lignosulfonate copolymers. In addition, both the prior art methods for impregnation of wood achieve only limited penetration of wood preservative in the wood. Therefore, it will be advantageous to have a wood treatment method that utilizes a preservative composition solely based on lignin, and that is applicable to the wood by a one-step method.

It is thus an object of this invention to provide a one-step method for treatment of wood to achieve its protection against decay.

It is a further object of the invention to provide a wood treating method that utilizes low-cost lignin or modified lignin.

It is another object of the invention to provide a method for treating wood that utilizes both lignosulfonate and alkali lignin.

It is an additional object of the invention to provide a method for impregnation of wood with lignin-based preservatives, whereby good penetration of said preservatives into the wood is attained.

It is another important object of this invention to provide a method for treatment of wood, whereby desirable fixation of lignin-metal salts in the wood is made possible.

SUMMARY OF THE INVENTION

It has now been found that certain of the foregoing and related objects of the present invention are readily attained in a method for treatment of wood, whereby the wood is impregnated with a wood preservative composition comprising an aqueous solution of ammonium salt of lignin and ammonia complexes of certain metal cations such as $Cu(NH_3)_4^{++}$, $Zn(NH_3)_4^{++}$, and $Hg(NH_3)_2^{++}$. Said lignin is selected from the group consisting of alkali lignin, organosolv lignin, partially desulfonated sulfite lignin, and modified alkali or organosolv lignin.

The object of the invention is achieved by one-step impregnation of wood with the composition according to any standard pressure/vacuum cycles of wood preservative treatment process commonly practiced in the industry. Specifically, green wood (lumber, log, etc.) is placed in a solution of said preservative composition of suitable concentration under vacuum for a period of 10 to 60 minutes to substantially remove air in the wood, and subsequently subjected to a pressure of 100 to 150 psi for a period of 60 minutes or longer, depending on the retention rate desired. The impregnated wood is either air dried at ambient temperature or oven dried at 105° C. to let ammonia escape from the interior of wood, resulting in insolubilization and fixation of said lignin and metal salt(s) in the wood. The thus treated wood shows good retention and penetration by said preservative composition and low leachability by water.

DETAILED DESCRIPTION OF THE INVENTION

In accordance with the preferred embodiments of the invention, an effective method for the treatment of wood to prevent decay is attained by impregnating the wood with a preservative composition comprising an aqueous solution of ammonium salt of lignin and ammonia complexes of certain metal cations, said method having distinctive advantages over the prior art by: (1) achieving better penetration and retention of wood preservatives; (2) being a simple, one-step process readily adaptable to the wood preserving industry; (3) utilizing both major technical lignins (kraft and sulfite) currently available from lignin manufacturers; (4) not resorting to expensive modified lignins such as copolymerized lignins; and (5) providing a wood preservative composition that is environment friendly.

1) Ammonia Complexes of Metal Ions

Some stable ammonia complexes suitable for use in the invention are one of, or a combination of, cupric ammonia complex, $Cu(NH_3)_4^{++}$, zinc ammonia complex, $Zn(NH_3)_4^{++}$, and mercuric ammonia complex, $Hg(NH_3)_2^{++}$. These complexes are formed by adding aqueous ammonia to solutions of metal salts such as $CuSO_4$, $ZnSO_4$, $HgSO_4$, $CuCl_2$ and $Hg(NO_3)_2$, etc. As an example, addition of aqueous ammonia (or $NH_4OH$) to a solution of cupric sulfate causes color changes as follows:

$$\underset{\text{light blue}}{CuSO_2(aq.)} + 2NH_4OH \longrightarrow \underset{\text{white precipitate}}{Cu(OH)_2} + (NH_4)_2SO_4$$

$$Cu(OH)_2 + 4NH_4OH \rightleftharpoons \underset{\text{deep blue}}{Cu(NH_3)_4^{++}} + 20H^- + 4H_2O$$

In practice, a metal ammonia complex is prepared by addition of excess aqueous ammonia to the solution of a metal salt until the initially formed precipitate (metal hydroxide) becomes totally solubilized. At this point, the solution pH is about 9. Other metal ions (such as aluminum ions, $Al^{3+}$, U.S. Pat. No. 4,752,509) do not form ammonia complexes of good enough stability to be useful for the purposes of the instantly claimed invention.

2) Lignin

In accordance with a specific embodiment of the. invention, in the method of treating wood to prevent decay, the lignin for the wood preservative composition used in said method is selected from the group consisting of alkali lignin, organosolv lignin, partially desulfonated sulfite lignin, and alkali, or organosolv lignin that is chemically modified to increase the water solubility. Irrespective of the types of lignin employed, the only criterion for selecting a lignin suitable for the invention is that said lignin is soluble in an aqueous ammonia solution at pH of 9–11 so it can be absorbed with a metal ammonia complex or a combination of metal ammonia complexes in the impregnation process.

As used herein, the term "alkali lignin" refers to the class of lignin that is derived from the kraft and soda pulping processes, and is recovered as a precipitate from the pulping liquors of the pulp industry where lignocellulosic materials, such as wood, straw, corn stalks, bagasse and the like, are processed to separate the cellulose pulp from the lignin by treating said materials with caustic and/or sulfide. Likewise, "organosolv lignin" is recovered as a precipitate from organosolv pulping liquors generated in the pulping process whereby lignocellulosic materials are cooked at an elevated temperature (e.g., 200° C.) in alcohol-water mixtures (such as Alcell and Organocell processes). Alkali lignin and organosolv lignin are not sulfonated products, and thus water-insoluble at acidic pH. However, either can be readily modified, if desired, by reacting with a sulfite compound or a carboxylating agent, or by oxidizing with common oxidants of lignin such as $O_2$, $O_3$ and $H_2O_2$, or any combination of these reactions, to improve water solubility. The water solubility may be measured by the pH at which the initial lignin precipitation occurs (or precipitation pH) as defined in a standard procedure of this specification. Low precipitation pH corresponds to good water solubility.

In accordance with a preferred embodiment of the method, the precipitation pH of alkali lignin, organosolv lignin, or their modified products, is between 0.1 and 7, and preferably between 0.5 and 2. Too low a precipitation pH (high water solubility) will cause the lignin to be leached out of wood by water. In contrast, a high precipitation pH (low water solubility) tends to make it difficult to prepare a wood preservation solution of high concentration (about 40% by solids), or to reduce the storage stability of the preservative solution with time. As an illustration, the relationship between precipitation pH and degree of sulfonation is shown in Table 1. As it should be obvious the relationship will vary with the type of non-sulfonated lignin employed due to differences in the contents of functional groups (phenolic hydroxyl and carboxyl) and molecular weight that necessarily affect the solubility of the lignin.

TABLE 1

Relationship between precipitation pH and degree of sulfonation for a typical lignin isolated from Kraft black liquors.

| Degree of Sulfonation (m mol/g) | Precipitation pH |
|---|---|
| 0 | 6.5 |
| 0.25 | 4.5 |
| 0.5 | 3.0 |
| 0.75 | 1.7 |
| 1.0 | 1.0 |
| 1.5 | 0.7 |

The term "sulfite lignin" refers to the sulfonated lignin material conventionally and inherently obtained in the sulfite pulping of wood and other lignocellulosic materials. It is also called "lignosulfonate", and is the principal constituent of spent sulfite liquor. It also refers to the spent sulfite liquor solids which contain, besides the principal constituent, wood sugars and other organic compounds. Sulfite lignin as derived from the spent sulfite liquor is too water-soluble (with a precipitation pH below 0.1) to be useful in the invention method of impregnating wood. As stated in U.S. Pat. No. 4,988,576, lignosulfonate absorbed into the wood that is subsequently treated with a metal salt such as copper and zinc salts, is easily leached out of the wood by water and loses its effectiveness as a wood preservative. For the purpose of the invention, sulfite lignin is partially desulfonated by alkaline oxidation or high-temperature alkaline treatment, to reduce the sulfonic sulfur content to less than about 3% on dry weight of the lignin. A commercially available product, Marasperse CB, from LignoTech USA, Inc. is an example of alkaline oxidized, partially desulfonated sulfite lignin. Specifically, suitable partially desulfonated sulfite lignin has a precipitation pH of at least 0.5, but not higher than 7.

The lignin employed herein is preferably in an acid form, that is, all carboxylic and phenolic hydroxyl groups are protonated, instead of as a salt. A lignin salt can be conveniently converted to the acid form by reacting said salt with a mineral acid, e.g.,

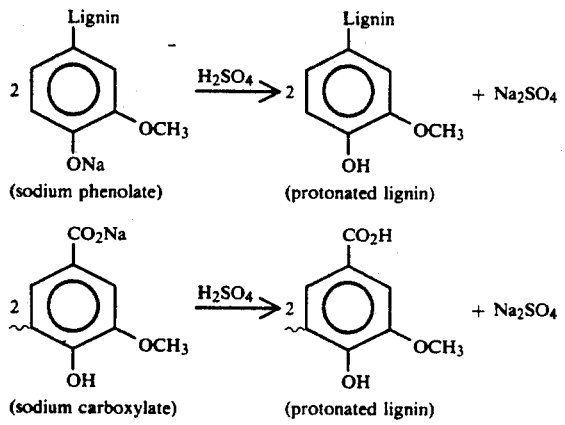

The precipitate of protonated lignin is then washed free of the salt of mineral acid, and recovered as a filter cake by filtration. Alternatively, the mineral salt may be used together with the protonated lignin without separation. The protonated lignin precipitate must be made into a solution with aqueous ammonia before it is used as a preservative component. This can be done by slowly adding aqueous ammonia (ammonium in water exists as ammonium hydroxide) to a slurry of precipitated lignin until the lignin dissolves completely. The pH at which the total solubilization occurs depends on the water solubility (and precipitation pH) of said lignin. Lignin of low precipitation pH generally requires less amount of aqueous ammonia (and accordingly low solution pH) to become soluble. However, in accordance of the practice of the invention, the pH of the ammoniacal solution of lignin should be at least 9, but not higher than 11, preferably between 9 and 10. The lower pH limit is necessary because it is the solution pH of an ammonia metal complex [e.g., $Cu(NH_3)_4^{++}$.

Although a precipitated lignin can be solubilized by addition of sodium hydroxide as is indeed practiced in the prior art two-stage impregnation method, the use of sodium hydroxide will definitely cause the invention one-step method to fail. The reason for the difference is that while in the prior art method (U.S. Pat. No. 4,752,509), the alkali-solubilized lignin introduced into wood in the first-stage impregnation, is neutralized and rendered insoluble by the acidic solution of a metal salt (e.g. $CuSO_4$), the lignin absorbed by the wood in the instantly claimed method is insolubilized by the escape of ammonia during drying of the treated wood (contrary to sodium hydroxide that does not escape from the wood in drying). The disappearance of ammonia lowers the pH in wood, causing insolubilization and fixation of lignin and metal ions.

It should be mentioned in this connection that because of the distinctively different mechanism of fixation of lignin and metal ions, the prior art method requires a relatively large quantity of metal ions to transform the lignin into its water-insoluble form during the second stage of treatment, and the quantity increases in line with the increase in the quantity of lignin used in the impregnation. By contrast, the insolubilization of lignin in the present method is less dependent on the metal ions, and the required quantity of metal ions is more or less independent of the quantity of lignin employed. Therefore, the ratio of lignin and metal ions can be adjusted solely based on the consideration of requirements of wood preservative.

3) Preparation of Wood Preservative

An effective wood preservative is simply prepared by blending an ammonium salt of the lignin and metal ammonia complex (e.g., copper ammonia complex) at the lignin/metal weight ratio of from 1: 0.01 to 1: 1.2. The pH of the mixture is kept at 9 to 11, preferably 9 to 10. With desulfonated sulfite lignin and low sulfonated alkali lignin having precipitation pH of 0.5 to 2, it is possible to prepare a stable wood preservative mixture at a solids concentration of 30 to 40%, and at pH 10. However, with less water-soluble lignin such as unsulfonated alkali or organosolv lignin, the pH of the preservative mixture needs to be adjusted to 11 with aqueous ammonia.

4) Method of Impregnation

In treatment of wood with the wood preservative composition described heretofore, any standard impregnation procedure commonly practiced in the industry may be used, and particularly the vacuum/pressure cycles of wood preservative treatment process can be followed. Specifically, it is recommended that green wood (lumber, log, etc.) be placed in a solution of said preservative composition of suitable concentration (depending on the retention rate desired) under vacuum for a period of 10 to 60 minutes, and subsequently subjected to a pressure of 100 to 150 psi for a period of 60 to 90 minutes. The impregnated wood is either air dried at ambient temperature or oven dried at 105° C. to 120° C. until practically all ammonia is eliminated from the wood. Alternatively, a final vacuum period may be employed (as in commercial full-cell, Lowry and Rueping processes) in the treatment cylinders to remove ammonia gas from the treated wood, thus avoiding the drying step at the elevated temperature.

The practice and advantages of this invention may be clearly seen in the following examples.

EXAMPLE 1

This example demonstrates the benefits of the one-step method of this invention for treating wood. Thus, pine wood blocks ($4.5\times4.5\times4.5$ cm$^3$) were placed in a 2-liter pressure reactor with a solution of 10% lignin (as ammonium salt) and 1% copper (as $Cu(NH_3)_4^{++}$), and the contents were subjected to vacuum for 30 minutes and subsequently to a nitrogen pressure of 150 psi for 30 minutes. The impregnated wood blocks were dried in an oven at 105° C. overnight. In a leachability test, the treated wood blocks were soaked in water under vacuum for 24 hours. After drying again at 105° C. overnight, the weight loss of the blocks was determined. The percentage of preservative retained in the wood blocks was calculated from the weight loss by difference. Similarly, the pine wood blocks were impregnated according to the two-step method of U.S. Pat. No. 4,752,509 by first treating with 10% alkaline solution of the lignin (pH 8 to 10 depending on type of lignin), followed sequentially by drying and a second step of impregnation with an acidic (pH 3 to 4) solution of copper sulfate to fix the lignin and copper in the wood. The leachability test of the wood blocks was determined as above. The data shown in Table 2 indicate that the cupric lignin salts introduced into the wood by the invention one-step impregnation method are at least as resistant to leaching by water as that absorbed and fixed in the prior art two-step procedure.

TABLE 2

Leachability of cupric lignin salts.

| Lignin | Description | % Preservative retained in wood blocks after leaching | |
|---|---|---|---|
| | | Invention | Prior Art |
| Curan 100 | Kraft Lignin | 76 | 63 |
| Marasperse CB | Desulfonated Sulfite Lignin | 83 | 85 |
| Reax 85A | Sulfonate Kraft Lignin | 78 | 68 |

Note:
Curan 100, product of LignoTech Sweden; Marasperse CB, product of LignoTech USA, Inc.; Reax 85A, low sulfonated pine k lignin from Westvaco Corp.

EXAMPLE 2

The pine wood blocks were treated with a wood preservative composition consisting of 5% lignin (as an ammonium salt) and 1.5% copper (as cupric ammonia complex) according to the invention one-step method. The retention rate of the preservative after the leaching test was determined as in Example 1. The water solubility of lignin was measured by its precipitation pH of which a standard procedure of determination is outlined as follows: Weigh out one gram of lignin solids (or equivalent amount of liquid) and dissolve in water to make up a 2% solution. Acidify the solution by dropwise addition of 4N $H_2SO_4$ to various pH values. Centrifuge the lignin solution/slurry immediately after adjustment at 3500-4000 rpm for 30 minutes. Decant supernatant and dry the insoluble lignin in an oven at 110° C. overnight. Plotting the precipitated lignin solids versus pH gives precipitation curves. Precipitation pH is determined from the precipitation curve as the inception point of lignin precipitation.

The precipitation pH and percent retention of preservative after leaching are listed in Table 3 for each of the commercial lignins evaluated. The data indicate that except for the unmodified sulfite lignin (Lignosol X) having high water solubility (low precipitation pH), all other lignin products (standard kraft lignin, sulfonated kraft lignin and desulfonated sulfite lignin) exhibit a good resistance to leaching by water when formulated with cupric ammonia complex and introduced into the wood according to the invention one-step impregnation method.

TABLE 3

Relationship between precipitation pH and percent preservative retention after leaching in water.

| Lignin Product Name | Description | Precipitation pH (2% Solution) | % Preservative retention after leaching |
|---|---|---|---|
| Lignosol X | Softwood sulfite lignin | <0.1 | 58 |
| Marasperse CB | Desulfonated sulfite lignin | 1.1 | 89 |
| Reax 85A | Sulfonated kraft lignin | 1.0 | 79 |
| Polyfon O | Sulfonated kraft lignin | 1.9 | 76 |
| Curan 100 | Kraft lignin | 6.5 | 76 |
| Diwatex 30 FKP | Sulfonated kraft lignin | 0.5 | 84 |

Note:
Lignosol X and Marasperse CB, products of LignoTech USA, Inc.; Reax 85A and Polyfon O, products of Westvaco Corp.; Curan 100 and Diwatex 30 FkP, products of LignoTech Sweden.

EXAMPLE 3

This example was designed to show that a combination of ammonium salt of lignin and metal ammonia complex has a better leaching resistance than either the lignin salt or ammonia complex alone. Thus, pine wood blocks were impregnated with the combination, lignin salt or the complex separately, and the leachability of the absorbed materials was determined after repeated soaking/drying cycles. The percentage of absorbed solids retained in the wood blocks after each cycle is shown in Table 4. The data clearly show that cupric ammonia complex was leached out of the wood rapidly by water and the wood lost more than 80% of the weight gain after only two soaking/drying cycles. The desulfonated sulfite lignin (Marasperse CB) appears to adsorb more strongly onto the wood than the metal ammonia complex. Even so, its large portion (40%) was lost in the first leaching cycle. The combination exhibits a good leaching resistance, and it demonstrates the viability of the invention one-step method for treatment of wood.

TABLE 4

Leachability test of wood preservative and components.

| Composition for Wood Impregnation | % Preservative Retained after Number of Leaching/Drying Cycles | | | | |
|---|---|---|---|---|---|
| | 1 | 2 | 3 | 4 | 5 |
| $Cu(NH_3)_4^{++}$, pH 9 | 36 | 17 | — | — | — |
| $NH_4$- salt of desulfonated sulfite lignin (Marasperse CB) pH 10.5 | 60 | 54 | 48 | 45 | 42 |
| $NH_4$ salt of Marasperse CB + $Cu(NH_3)_4^{++}$, pH 10.5 | 89 | 74 | 65 | 58 | 52 |

TABLE 5

Penetration of heartwood in pine wood blocks in the invention one-step and the prior art two-step treatment processes.

| Wood Preservative Composition | Treatment Time (minutes) | Penetration depth (cm) along longitudinal direction in pine heartwood: Invention One-Step | Prior Art Two-Step |
|---|---|---|---|
| 2.5% Marasperse CB + 0.75% Copper | 30 | 1.2 | 0.2 |
| 2.5% Reax 85A + 0.75% Copper | 240 | 1.5 | 0.7 |
| Control (water) | 240 | 1.5 | 1.5 |

Note:
Treatment time refers to the time at 190 psi pressure, in addition to 5-minute vacuum prior to the pressure treatment. In the control test, a water-soluble blue dye, Pontamine Fast Turquoise 8GL, was added to the treatment water to facilitate the detection of water penetration zone in the wood.

EXAMPLE 4

While the effectiveness and ultimate economy of a given preservative treatment are determined by the service life of the wood (timber) involved, the immediate criteria of the adequacy of the treatment are the amount of preservative absorbed by the wood, leachability of the retained preservative and the depth to which it has penetrated (penetration depth). Inadequately penetrated wood may be subject to early. failure. A considerable number of factors influence the impregnation of timber, such as (1 ) the anatomy of wood, (b) the preparation of the timber, and (c) the treating procedure (see *Wood Preservation* by Hunt and Garatt, McGraw-Hill, New York, 1953). Varying resistance to impregnation by preservatives has been experienced with different species, and even different pieces of the same kind of wood. Among the many anatomical factors, the so-called sapwood and heartwood of a tree offer the greatest variation with respect to penetrability. Generally, heartwood is much more difficult to penetrate than sapwood.

The penetration of lignin wood preservatives along the longitudinal direction of pine heartwood was measured in the invention one-step and the prior art two-step treatment processes. The wood specimens used in the measurements are 5-inch segments cut out of 2×4 untreated pine lumber available from a building materials store. Under the treatment conditions, sapwood was completely penetrated in either treatment processes, but the penetration of heartwood was poor. The penetration data obtained in the experiment are shown in Table 5. A better penetration was achieved repeatedly in the invention method.

Thus, it can be seen that the present invention provides a method for treatment of wood, which achieves good retention, leachability and penetration of wood preservatives by a simple one-step impregnation process readily adaptable to the wood preserving industry. Moreover, the invention provides a method for treating wood to prevent decay, utilizing various lignin materials that are low-cost, non-toxic and derivable from the renewable forest resources.

Various modes of carrying out the invention are contemplated as being within the scope of the following claims particularly pointing out and distinctly claiming the subject matter regarded as the invention.

I claim:

1. A method for treatment of wood, comprising the steps of:

a. forming an aqueous solution consisting of essentially ammonium salt of lignin and a metal ion ammonia complex, said metal ion selected from the group consisting of copper, zinc and mercury, and the composition of said solution having a weight ratio between the metal ions and lignin of from 1:0.01 to 1:1.2;

b. impregnating wood with said aqueous solution until an effective quantity of metal salts of lignin is absorbed therein for the purpose of preventing the decay of said wood; and c. Drying the impregnated wood for a sufficient length of time to substantially remove ammonia gas from the wood.

2. The method of claim 1 wherein the pH of the aqueous solution is between 9 and 11.

3. The method of claim 1 wherein the pH of the aqueous solution is between 9 and 10.

4. The method of claim 1 wherein the metal ion ammonia complex is a mixture of aqueous ammonia and a metal salt selected from the group consisting of $CuSO_4$, $ZnSO_4$, $HgSO_4$, $CuCl_2$, and $Hg(NO_3)_2$.

5. The method of claim 1 wherein said lignin is selected from the group consisting of kraft lignin, soda lignin, organosolv lignin and partially desulfonated sulfite lignin.

6. The method of claim 1 wherein said lignin is selected from the group consisting of kraft lignin, soda lignin and organosolv lignin, each modified to increase its water solubility so that the precipitation pH of said modified lignin is between 0.5 and 2.

7. The method of claim 6 wherein said modified kraft, soda or organosolv lignin is a sulfonated, carboxylated or oxidized reaction product of a kraft, soda or organosolv lignin respectively.

8. The method of claim 5 wherein said lignin has a precipitation pH of from 0.1 to 7.

9. The method of claim 5 wherein said lignin has a precipitation pH of from 0.5 to 2.

10. The method of claim 8 wherein said lignin is in a protonated form that is converted to its ammonium salt by reacting with aqueous ammonia.

11. The method of claim 1 wherein the step of drying comprises air drying at ambient temperature.

12. The method of claim 1 wherein the step of drying comprises oven drying at 105° C. to 120° C.

* * * * *